United States Patent [19]

McGregor

[11] Patent Number: 4,612,965

[45] Date of Patent: Sep. 23, 1986

[54] AUTOMATIC BAG HANGING DEVICE

[76] Inventor: Harold R. McGregor, 1444 Lincoln Ave. SE., Qwatanna, Minn. 55060

[21] Appl. No.: 646,639

[22] Filed: Aug. 30, 1984

[51] Int. Cl.[4] ..... B65B 1/04; B65B 1/18; B65B 43/26

[52] U.S. Cl. ..... 141/114; 141/315; 141/166; 53/571

[58] Field of Search ..... 141/129–191, 141/1–12, 68, 114, 313–317, 250–284; 53/459, 384, 570, 571

[56] References Cited

U.S. PATENT DOCUMENTS 4,310,037 1/1982 Seals ..... 141/166

*Primary Examiner*—Houston S. Bell, Jr.

*Attorney, Agent, or Firm*—Williamson, Bains, Moore & Hansen

[57] ABSTRACT

The invention shows a device for hanging bags to be filled. A fold-down arm with suction cups grabs the front bag of a vertically oriented stack of bags and folds the top portion of the bag down over a drum. The top edge of the bag is then registered at a predetermined position at which point a delivery and hanging arm removes the bag from the fold-down arm and hangs it on a spout which is movable between first and second positions. A Duplex system may be utilized wherein two sets of the above mentioned parts are located parallel to one another and which discharge filled bags concurrently into a sealing machine.

20 Claims, 6 Drawing Figures

AUTOMATIC BAG HANGING DEVICE

BACKGROUND OF THE INVENTION

This invention relates to bag handling machines of the type which include a hopper from which particulate material is dispensed in predetermined quantities or batches through a spout having a discharge end on which a bag is hung for filling. Machines of this general type are shown in my prior U.S. Pat. No. 4,432,186 and U.S. Pat. No. 4,322,932, the contents of which are hereby incorporated by reference. While such machines have proven to be satisfactory, it is always desirable to improve the through-put of such machines. Since in general such machines are limited by the filling speed of a given sized spout, it is therefore desirable to produce a machine which maximizes available time of a bag on the spout for filling and which minimizes the other portions of the hanging and discharging cycle so as to produce an optimum throughput.

SUMMARY OF THE INVENTION

A stack of bags is oriented vertically, that is with the bottom edge of the bag located on a generally horizontal surface and the planar faces of the bags being oriented vertically. The front bag of the stack is located next to a fold-down pickup arm which is movable between a pickup position wherein the arm is vertically oriented and a transfer position wherein the arm is horizontally oriented by pivoting away from the stack. The fold-down arm has mounted thereon a gripping member having suction cups. The gripping member is slidably located on tracks on the fold-down arm.

The fold-down arm is rotatably mounted on a movable registration arm, the purpose of which will be described hereinafter. A piece of spring steel is used to connect the registration arm and the gripping member and is mounted over a cylindrical member such that when the fold-down arm moves from the pickup position to the transfer position, the gripping member slides inwardly towards the axis of rotation. In doing so, the fold-down arm picks up the top bag from the stack when in the pickup position and as the fold-down arm folds down to the transfer position, the gripping member moves inwardly while continuing to grip the front of the bag. The geometry is such that the top of the bag is folded down over the cylindrical member and because of the sliding gripping member, the bottom of the bag does not move but rather remains in place.

Upon the fold-down arm reaching the transfer position, the registration arm is caused to pivot forwardly thereby moving the front or leading edge of the bag until it reaches a predetermined registration position as signalled by the leading edge of the bag crossing a light beam from a light source and complementary photocell. At this point, movement of the registration arm stops and a delivery and hanging arm grips the bag. The delivery and hanging arm then moves upwardly and hangs the bag on a movable spout which is in a first position relatively closer to the bag stack than the spout second position. The gripping mechanism on the spout itself is shown in more detail in my prior patents as mentioned heretofore. Upon the bag being hung on the spout, the bag starts to fill and during the filling, the spout moves from the first position to the second position where upon completion of the filling, the bag is released onto a conveyor whence it is conveyed away for sealing.

The fold-down arm may also be moved to a third position after the delivery and hanging arm has grabbed the bag in order to separate the suction cups from the bag, and prevent wear thereto as the delivery and hanging arm pulls the bag away from the fold-down arm.

In order to further maximize the capacity of such machines, two sets of most of the component parts above may be included together to form a duplex bagging machine. Thus, parallel stacks of bags, fold-down arms, delivery and hanging arms and spouts are located next to one another and operate in unison with one another. The bags are then discharged onto the same conveyer for sealing and further processing on a common line. The capacity of the sealers is generally such as to allow a single sealer to be used with multiple filling stations. Thus, increased efficiencies are had by such an approach.

Registration of the top edge of the bag is particularly important with respect to pinch bottom bags and the structure set forth allows extremely precise registration of this edge.

These and other objects and advantages of my invention will appear more fully from the following description made in conjunction with the accompanying drawings wherein like reference characters refer to the same or similar parts throughout the several views.

DESCRIPTION OF THE DRAWING FIGURES

DESCRIPTION OF THE PREFERRED EMBODIMENT

Figure 1:
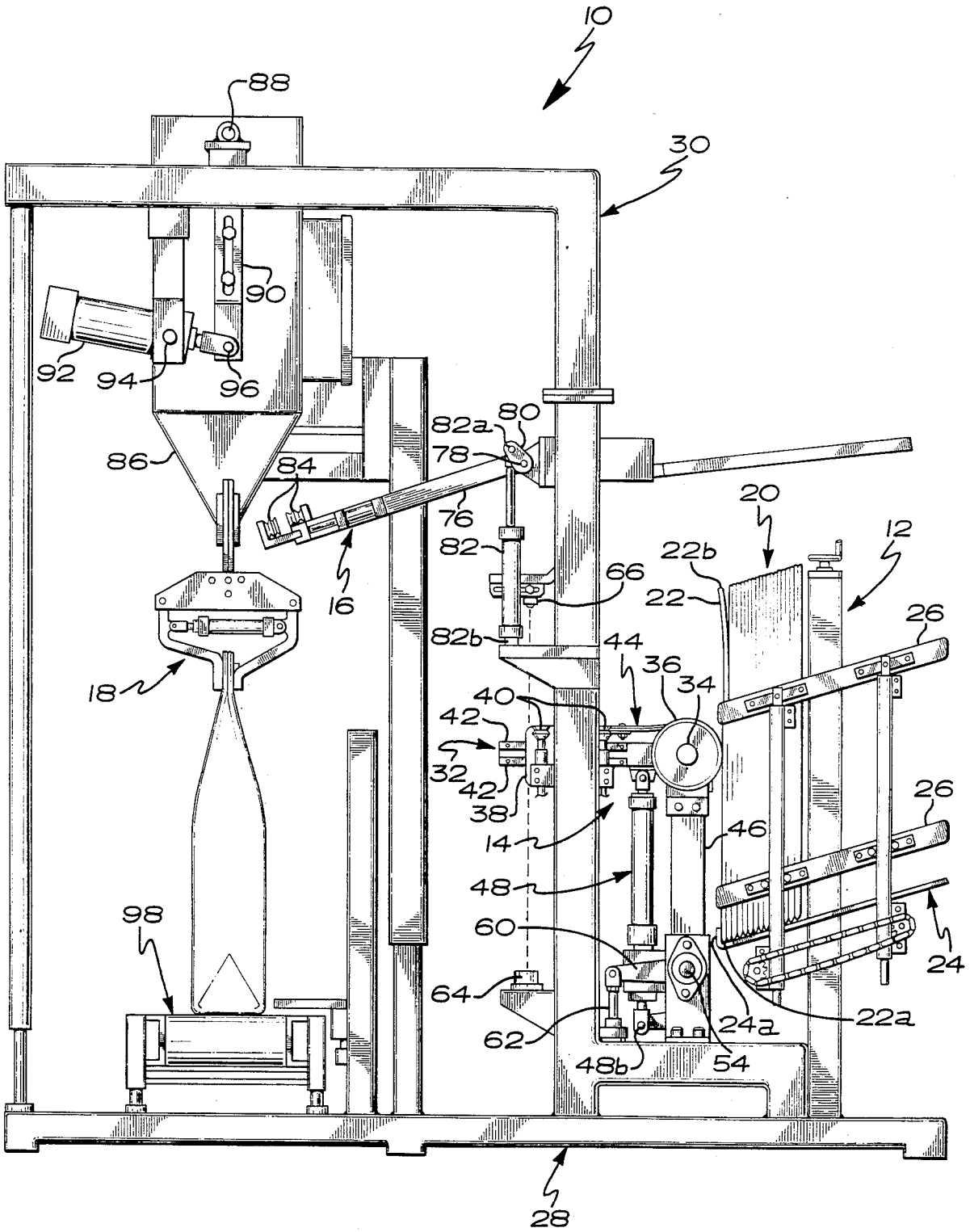
FIG. 1 is a side view of the device of the instant invention.

The device of the instant invention generally designated 10 is shown in general in FIG. 1. The component assemblies of bag pickup and hanging mechanism 10 are shown and designated by a stack holding mechanism 12, a feed mechanism 14, a delivery and hanging mechanism 16, and a gripping mechanism 18. In particular, a vertically oriented bag stack 20 is provided and has located thereon a front bag to be gripped 22, front bag 22 having a bottom edge **22*a* and a top edge 22*b*. The bottom of bag stack 20 rests in a bag tray 24 having a front lip 24*a* for restraining front bag 22. Bag tray 24 is also provided with side rails 26**.

As can be seen in general, bag tray 24 rests on a base 28 which is part of a frame 30 in general. A fold-down arm 32 is provided as part of the feed mechanism 14. In particular, fold-down arm 32 pivots about a pivot axis 34 which has located thereabouts a cylindrical drum 36 over which the bag is folded. A gripping member 38 is slidably located on arm 32 and has provided thereon suction cups 40 which are connected switchably to a source of vacuum. Gripping member 38 is slidably mounted on fold-down arm 32 by means of V-shaped tracks 42. A spring metal member 44 is attached at one end 44*a* to gripping member 38 and passes over drum 36 for attachment at second end 44*b* to registration arm 46. The pivot axis of rotation 34 of fold-down arm 32 is attached to the upper end of registration arm 46. A two-stage hydraulic cylinder 48 is used to rotationally position fold-down arm 32. The upper end 48*a* of cylinder 48 is attached adjacent the base of fold-down arm 32 and the lower end 48*b* of cylinder 48 is attached to frame 30. Cylinder 48 is a two-stage cylinder having first and second stages 48*c* and 48*d*, respectively. A mounting bracket 52 pivotably mounts shaft 54 which has located thereon a cam 56 which in turn acts against complementary cam bearing surfaces 58 as will be more fully described hereinafter. A cam actuating arm 60 is attached to shaft 54 and is in turn actuated by a cylinder 62.

Figure 5:
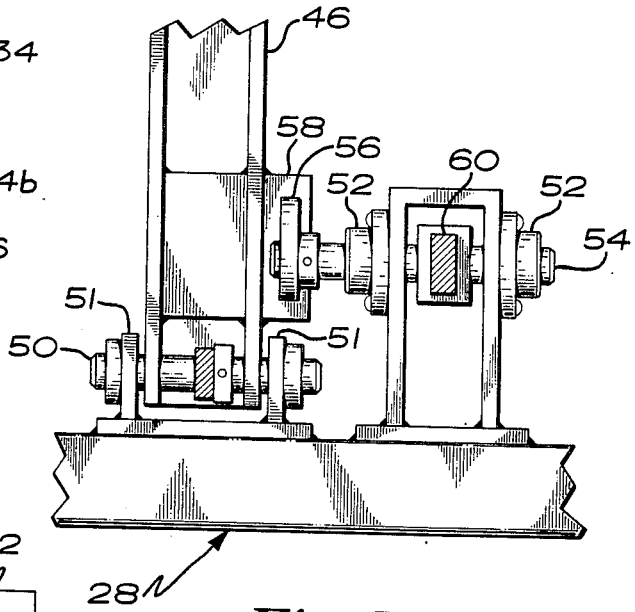
FIG. 5 is a detailed front view showing the registration mechanism.

A pivot shaft 50 is located in mounting bracket 51 and registration arm 46 rotates about shaft 50 as shown in FIG. 5.

A light source 64 and complementary photocell 66 mount to frame 30 to provide an indication of proper registration of the top edge 22*b* of the bag being processed. The particular functioning of this will be described more fully hereinafter.

A delivery and hanging arm 76 pivots about a pivot axis 78 and is actuated by means of an actuating arm 80 attached to a cylinder 82. Cylinder 82 is provided with first and second ends 82*a* and 82*b*, respectively.

Bag clamps 84 are located at the distal end of delivery and hanging arm 76 and are shown in detail in my above referenced prior patents. A spout 86 is pivotably mounted via shaft 88 at the top of frame 30. Spout 86 is provided with a pivot arm 90 which is in turn attached to cylinder 92 at pivot point 96. Cylinder 92 is mounted to frame 30 at pivot point 94.

Figure 6:
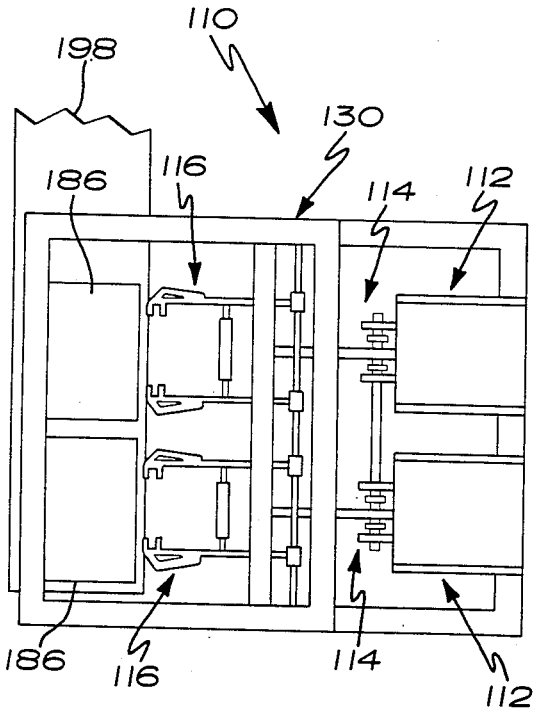
FIG. 6 is an overhead view of the duplex mechanism.

A duplex mechanism 110 for parallel processing of two sets of bags and filling mechanisms is shown in FIG. 6. In particular, parallel stack holding mechanisms 112 are serviced by feed mechanism 114 from which hanging mechanisms 116 hang the bags on spouts 186. A frame 130 contains all of the various components and a single conveyer 198 serves to carry the bags away after filling.

OPERATION OF THE INVENTION

Figure 2:
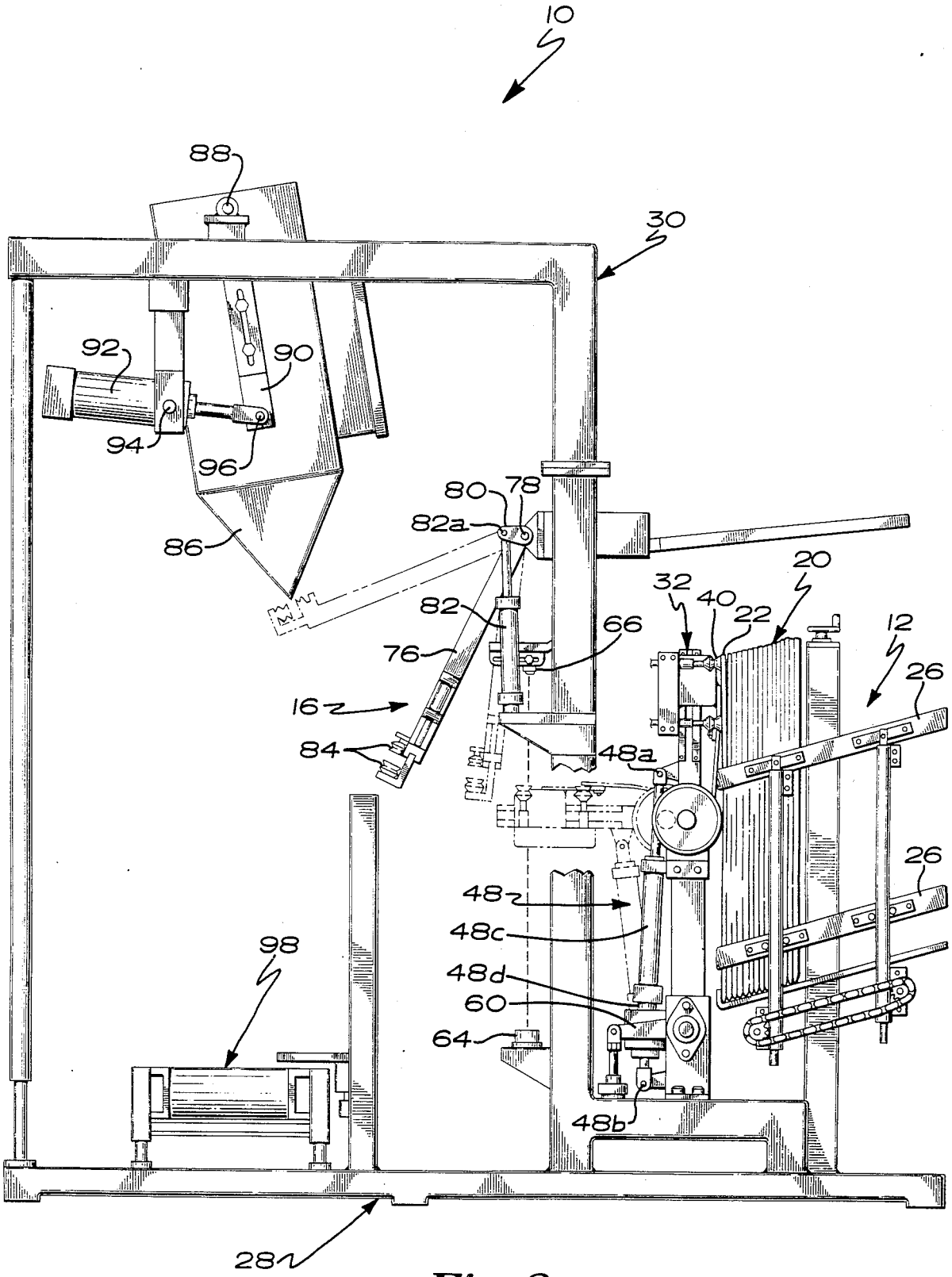
FIG. 2 is a similar view to FIG. 1 showing several of the parts in different positions.
Figure 3:
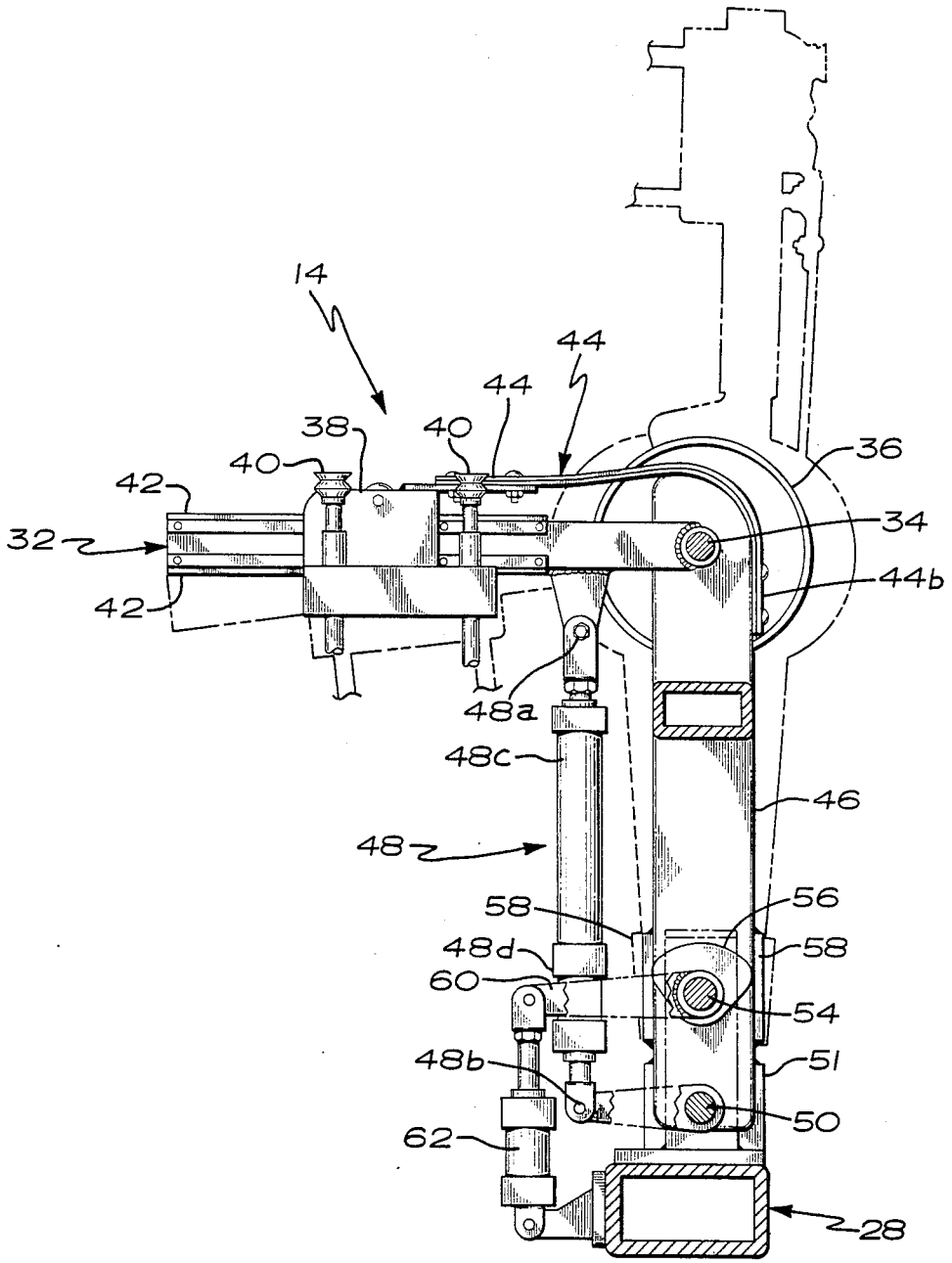
FIG. 3 is a more detailed side view of fold-down and registration arms showing several different positions in phantom.
Figure 4:
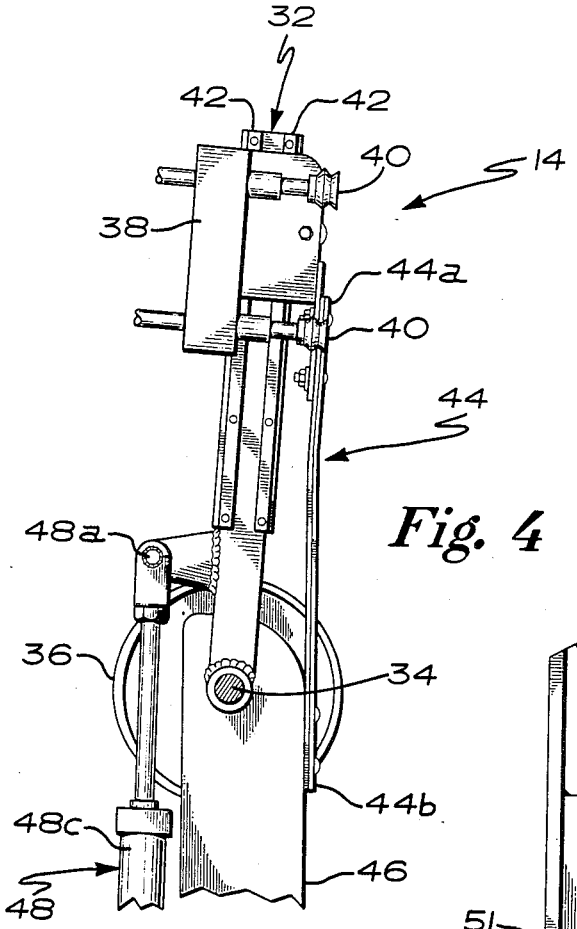
FIG. 4 is an even more detailed view of the fold-down arm in the first position.

Initially, the stack of bags 20 is placed in bag tray 24. Fold-down arm 32 is in the pickup position as shown in FIGS. 2 and 4 with the gripping member 38 slidably located toward the outer end of fold-down arm 32. At this point, suction cups 40 are connected to a source of vacuum and front bag 22 gripped at the top edge 22*b* thereof. Thence, the first stage 48*c* of cylinder 48 is energized thereby rotating fold-down arm 32 to the transfer position shown in FIG. 1 and in solid form in FIG. 3. Note that as fold-down arm 32 rotates to the transfer position shown, gripping member 38 is slidably pulled inwardly on arm 32 along track 42 by means of spring member 44 which is bent about cylindrical drum 36. In doing so, the bottom portion of front bag 22 is not moved and hence, the gripping of the bag may be fairly light.

At this point, cylinder 62 is actuated thereby pulling downwardly on cam arm 60 and rotating shaft 54 to turn cam member 56 against cam bearing surface plates 58. As cylinder 62 is actuated then, registration arm 46 moves to the left as shown in phantom in FIG. 3 until the top edge 22*a* of bag 22 breaks the light beam from light source 64. At this point, the top edge of the bag is registered and actuating cylinder 62 is stopped immediately. At this point, grippers 84 on delivery and hanging arm 16 grip the top edge 22*b* of bag 22 and move upwardly to place bag 22 on spout 86. Spout 86 at this transfer point is located in the first position shown in FIG. 2. As delivery and hanging arm 76 pulls away from fold-down arm 32, a second stage 48*d* of cylinder 48 is actuated pulling fold-down arm 42 downward slightly to a third position to remove cups 40 from contact with the surface of the bag as the bag is being pulled away. The bag filling is started as soon as it is hung by grippers 18 on spout 86. As the filling progresses, cylinder 92 is actuated thereby moving spout 86 from the first position shown in FIG. 2 to the second position over conveyer 98 shown in FIG. 1. Upon completion of the filling, the bag is carried away by means of conveyor 98. Of course, as the spout 86 has finished filling one bag, the fold-down arm 32 is in the process of picking up another bag for hanging.

It can be appreciated that multiple spout systems 110 may be utilized as shown in FIG. 6. In particular, two sets of equipment as set forth herein are located side-by-side in parallel fashion. The components operate in unison, that is in phase with one another, and the two bags are carried away on the conveyor in the same direction, one next to the other for serial processing through sealing machinery and the like at a common outlet.

While the preferred embodiments of the present invention have been described, it should be understood that various changes, adaptions and modifications may be made therein without departing from the spirit of the invention and scope of the appended claims.

What is claimed is:

1. An automatic bag pickup and hanging device, said device comprising:

bag supply means for positioning a stack of bags in a predetermined orientation;

pickup means comprising a fold-down arm reciprocally rotatable about an axis of rotation between a pickup position adjacent said bag supply means and a transfer position;

a means on said fold-down arm for gripping a bag from said supply means;

a filling spout; and delivery means including means for engaging and holding a bag, said delivery means being movable between said transfer position and said spout for transfering said bag from said fold-down arm at said transfer position and hanging said bag on said spout, said delivery means being positioned spatially apart from said pickup means;

whereby the gripping means on the fold-down arm rotates in one direction to the pickup position and grips the bag from the bag supply means, the fold-down arm then rotating in the opposite direction to the transfer position with the bag gripped thereon, and the delivery means thence transfering the bag from the fold-down arm and hanging the bag on the spout;

and whereby the fold-down arm and the delivery means operate in timed unison, so that the top edge of a bag may be folded over and positioned at the transfer position by the fold-down arm while the delivery arm is engaged in hanging the previous bag.

2. The automatic bag pickup and hanging device of claim 1 wherein said spout is movable between a first position for receiving a bag to be filled and a second position for releasing said bag.

3. The automatic bag pickup and hanging device of claim 1 wherein said fold-down arm in said pickup position is substantially parallel to the face of said stack.

4. The automatic bag hanging device of claim 3 wherein said fold-down arm folds the bag being gripped around said axis as said fold-down arm moves from said pickup position to said transfer position.

5. The automatic bag pickup and hanging device of claim 4 wherein said gripping means is slidably mounted on said fold-down arm.

6. The automatic bag pickup and hanging device of claim 5 wherein said gripping means grips said bag adjacent the top of said bag.

7. The automatic bag pickup and hanging device of claim 6 further comprising means for positioning said gripping means slidably along said fold-down arm so as to prevent movement of the bottom of said bag as said fold-down arm rotates from said pickup position to said transfer position.

8. The automatic bag pickup and hanging device of claim 7 further comprising a registration arm, said fold-down arm being pivotably mounted to said registration arm.

9. The automatic bag pickup and hanging device of claim 8 wherein said positioning means comprises a spring member attached to said registration arm and said gripping means.

10. The automatic bag pickup and hanging device of claim 9 further comprising means for registering the top edge of said bag, whereby said registration means will register as the top edge of said bag is moved to said transfer position.

11. The automatic bag pickup and hanging device of claim 10 wherein said registration means comprises means for rotating said registration arm so as to move the top edge of said bag in a direction parallel to said fold-down arm until the top edge of said bag has reached said transfer position.

12. The automatic bag pickup and hanging device of claim 1 wherein said supply means supports a stack of bags on their bottom edges.

13. A duplex bag pickup and hanging system, said system comprising:

a plurality of bag supply means for positioning a plurality of bag stacks;

a plurality of pickup means comprising fold-down pickup arms, each rotatable about an axis of rotation between a pickup position adjacent the corresponding said bag supply means and a transfer position;

means on each said fold-down arm for gripping a bag from the corresponding stack at a supply means;

at least one filling spout;

delivery means movable between said transfer positions and said spout, for transferring a bag from said fold-down arms at said transfer positions and hanging said bags on said spout; whereby each set of pickup means and delivery means may operate independently to pick up and hang bags on the spouts.

14. The duplex bag pickup and hanging system of claim 13 wherein the corresponding pickup means and delivery means are located parallel to each other and feed a common outlet.

15. The duplex bagging system of claim 14 wherein each set of said pickup means and delivery means act in unison.

16. The automatic bag pickup and hanging device of claim 1 wherein said filling spout has a tip movable between a first and a second position, whereby a bag may be hung, filled, and unloaded in different position.

17. The automatic bag pickup and hanging device of claim 6 wherein said gripping means grips said bags on the planar surface of said bags.

18. The automatic bag pickup and hanging device of claim 16 wherein said gripping means comprises at least one vacuum producing suction device.

19. The automatic bag pickup and hanging device of claim 1 further comprising means in the path through which a bag is moved by said pickup means to said transfer position over which said bag is folded to present the edge at one end of the bag for engagement by said delivery means.

20. The automatic bag pickup and hanging device of claim 17 wherein said bags are made from a polyvinyl sheeting.

* * * * *